US006626091B1

(12) United States Patent
Lopresti et al.

(10) Patent No.: US 6,626,091 B1
(45) Date of Patent: Sep. 30, 2003

(54) PIZZA SCREEN MANUFACTURING APPARATUS

(76) Inventors: Joseph Lopresti, 32-26 150th St., Flushing, NY (US) 11354; Jim J. Bordonaro, 32-26 150th St., Flushing, NY (US) 11354; Frank Salerno, 32-26 150th St., Flushing, NY (US) 11354

( * ) Notice: Subject to any disclaimer, the term of this patent is extended or adjusted under 35 U.S.C. 154(b) by 0 days.

(21) Appl. No.: 10/374,991

(22) Filed: Feb. 28, 2003

(51) Int. Cl.[7] ..... A23L 1/00; A23L 3/04; A23P 1/00; A21C 9/04; A21C 9/08

(52) U.S. Cl. ..... 99/450.1; 99/349; 99/450.2; 99/494

(58) Field of Search ..... 99/349, 352–355, 99/450.1, 450.6, 450.7, 423, 427, 348, 372–380, 443 R, 443 C; 118/16, 18, 25, 411; 425/162, 168, 360, 429, 136, 151, 160, 293, 298, 324.1, 343, 317, 394, 412, 383, 398; 426/496, 512, 27, 279, 280, 523, 296, 303, 302

(56) References Cited

U.S. PATENT DOCUMENTS 3,221,672 A * 12/1965 Falco ..... 99/450.1
3,358,618 A * 12/1967 Verta ..... 99/450.1
3,725,974 A * 4/1973 Kuhlman ..... 99/450.7
3,760,715 A * 9/1973 Grote et al. ..... 99/494
3,892,171 A * 7/1975 Fitch et al. ..... 99/450.7
4,066,796 A * 1/1978 McKee ..... 426/302
4,112,834 A * 9/1978 Thiry ..... 99/494 X
4,152,976 A * 5/1979 Kawasaki et al. ..... 99/494 X
4,197,794 A * 4/1980 Raque et al. ..... 118/16
4,283,431 A * 8/1981 Giordano et al. ..... 426/296
4,367,243 A * 1/1983 Brummett et al. ..... 426/303
5,023,096 A * 6/1991 Plichman ..... 426/89
5,117,749 A * 6/1992 Bakker ..... 99/450.1
D459,939 S 7/2002 Johnson ..... D7/359

* cited by examiner

*Primary Examiner*—Timothy F. Simone

(57) ABSTRACT

A pizza screen manufacturing apparatus (10) having a folder (24L), crimper (24R), and flattener (26) to manufacture a pizza screen from a single sheet of screening by double folding over the peripheral edge in order to produce a product that evenly distributes heat through out the bottom surface of a pizza for even cooking thereof.

2 Claims, 6 Drawing Sheets

PIZZA SCREEN MANUFACTURING APPARATUS

BACKGROUND OF THE INVENTION

1. Field of the Invention

The present invention relates to pizza screen manufacturing apparatus. More particularly, the present invention relates to a pizza screen manufacturing apparatus which is able to double fold a peripheral edge of the screen.

2. Description of the Prior Art

Innovations for a pizza screen manufacturing apparatus have been provided in the prior art that are described as follows. Even though these innovations may be suitable for the specific individual purposes to which they address, they differ from the present invention as hereinafter contrasted.

In U.S. Pat. No. D459,939, invented by Johnson, titled, Football-shaped pizza screen which is an ornamental design for a football-shaped pizza screen.

The above patented invention differs from the present invention because it fail to describe or claim the apparatus of manufacturing and also has a metal edge along its periphery which is undesirable since the heat distribution is uneven through the bottom surface area of the pizza.

Numerous innovations for a pizza screen manufacturing apparatus have been provided in the prior art that are adapted to be used. Even though these innovations may be suitable for the specific individual purposes to which they address, they would not be suitable for the purposes of the present invention as heretofore described.

SUMMARY OF THE INVENTION

The types of problems encountered in the prior art are pizza screens all have an outer peripheral edge that is metal which unevenly distributes heat over the bottom surface area of the pizza causing unevenly distributed cooking and browning of the dough.

In the prior art, unsuccessful attempts to solve this problem were attempted namely: manufacturing the other peripheral edge in thinner metal. However, the problem was solved by the present invention because it utilizes a folding process to manufacture the entire screen from the same material.

Innovations within the prior art are rapidly being exploited in the field of pizza screen manufacturing.

The present invention went contrary to the teaching of the art which describes and claims pizza and baking screens with perforated central area and solid metal periphery.

The present invention solved a long felt need for a pizza screen that can evenly distribute heat throughout its surface.

Accordingly, it is an object of the present invention to provide a pizza screen manufacturing apparatus having a base, plate, first brace, second brace, wheel, motor, folder, crimper, flattener, and press.

More particularly, it is an object of the present invention to provide the base having a right base stanchion and left base stanchion.

In keeping with these objects, and with others which will become apparent hereinafter, one feature of the present invention resides, briefly stated, in the plate having a plate groove, plate center, plate shaft, and plate wheel.

When the first brace is designed in accordance with the present invention, it has a first brace left opening and first brace right opening.

In accordance with another feature of the present invention, the second brace has a second brace opening and second brace sanction.

Another feature of the present invention is that the folder has a folder stylus and folder disc.

Yet another feature of the present invention is that the crimper has a crimper stylus and a crimper disc.

Still another feature of the present invention is that the flattener has a flattener roller.

Yet still another feature of the present invention is that the press has a press plate.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—pizza screen manufacturing apparatus (10)
12—base (12)
12R—right base stanchion (12R)
12L—left base stanchion (12L)
14—plate (14)
14A—plate groove (14A)
14B—plate center (14B)
14C—plate shaft (14C)
14D—plate wheel (14D)
16—first brace (16)
16L—first brace left opening (16L)
16R—first brace right opening (16R)
18—second brace (18)
18A—second brace opening (18A)
18B—second brace sanction (18B)
20—wheel (20)
22—motor (22)
24L—folder (24L)
24LA—folder stylus (24LA)
24LB—folder disc (24LB)
24R—crimper (24R)
24RA—crimper stylus (24RA)
24RB—crimper disc (24RB)
26—flattener (26)
26A—flattener roller (26A)
28—press (28)
28A—press plate (28A)

DESCRIPTION OF THE PREFERRED EMBODIMENT

Figure 1:
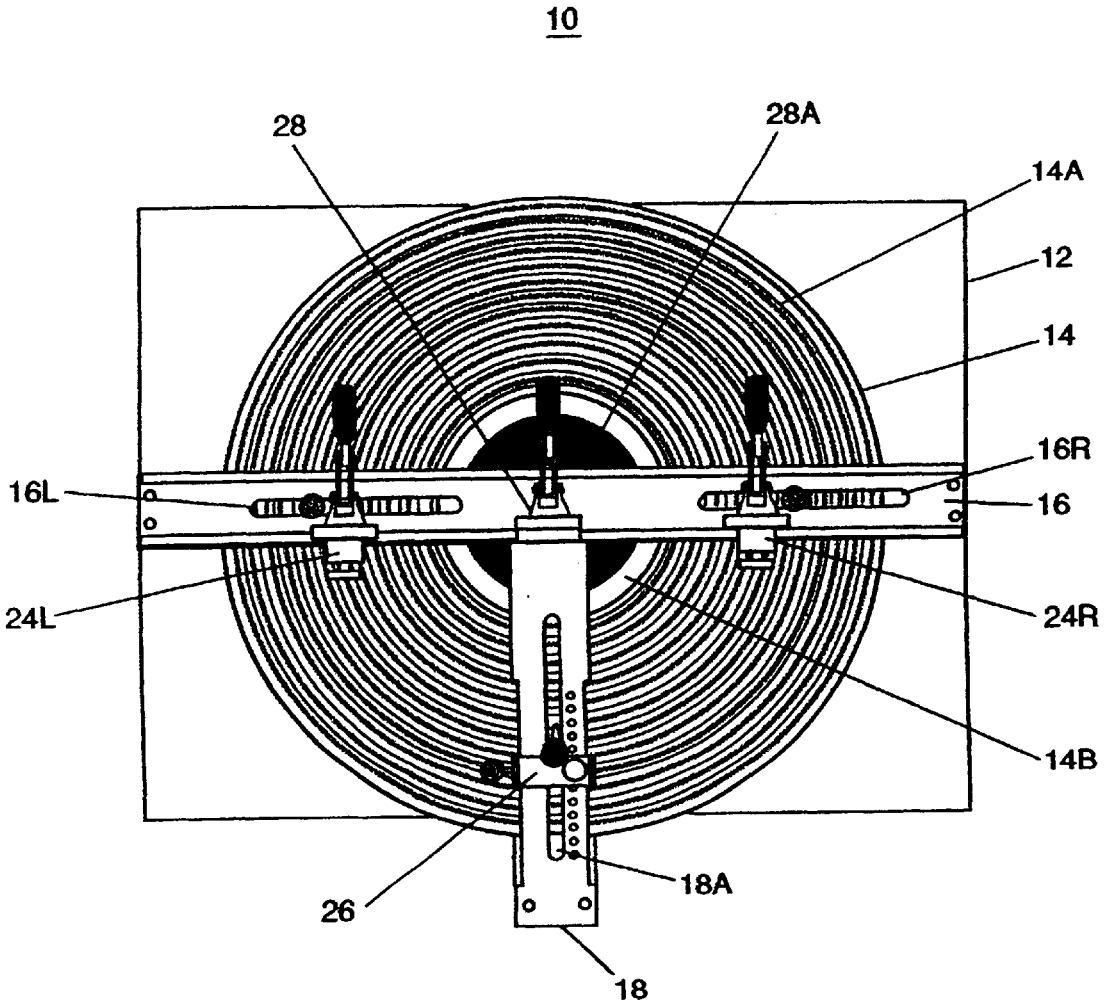
FIG. 1 is a top view of a pizza screen manufacturing apparatus (10).
Figure 6:
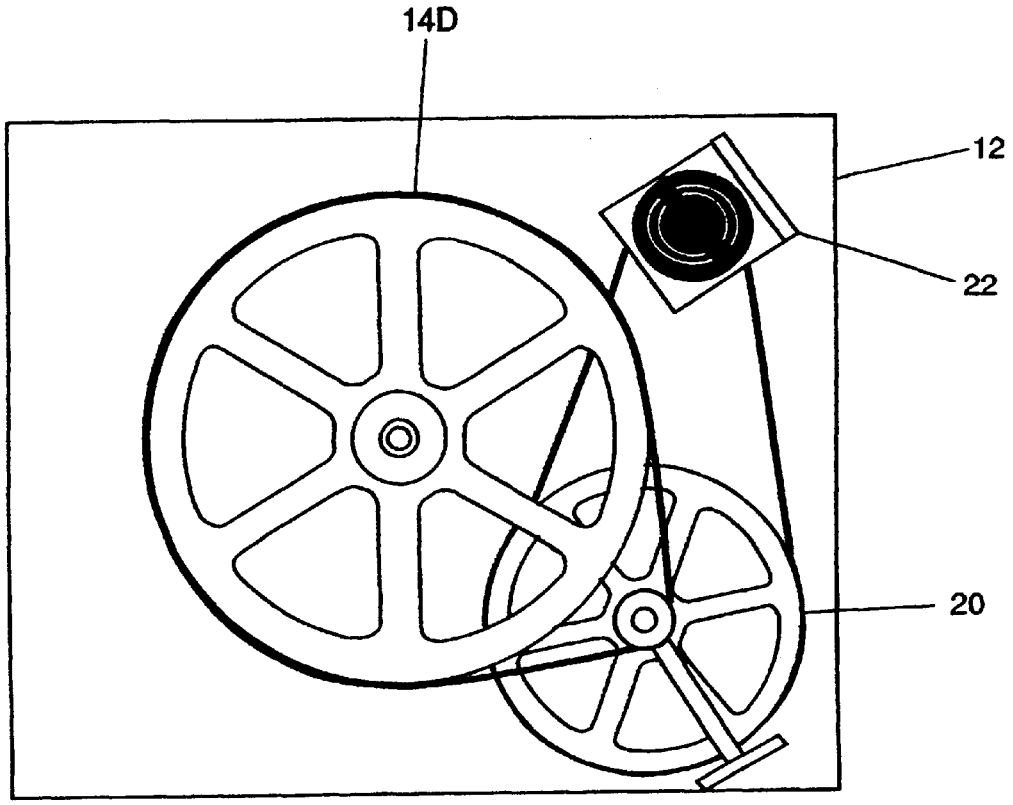
FIG. 6 is a bottom view of a pizza screen manufacturing apparatus (10).

Referring to FIG. 1 and FIG. 6 which are top and bottom views of a pizza screen manufacturing apparatus (10) comprises a base (12) having a right base stanchion (12R) and left base stanchion (12L). A plate (14) is rotatably mounted on the base (12). The plate (14) comprises a plurality of circular plate grooves (14A) and a flat plate center (14B). A plate shaft (14C) is securely connected at a top distal end to a bottom center of the plate (14) extending downwardly therefrom and securely connected at a bottom distal end to a center of a plate wheel (14D).

The pizza screen manufacturing apparatus (10) further comprises a first brace (16) securely connected to the base (12) on a left side by the left base stanchion (12L) and securely connected on a right side by the right base stanchion (12R). The first brace (16) comprises a first brace left opening (16L) and a first brace right opening (16R). A second brace (18) is connected at an outer distal end to the base (12) by a second brace sanction (18B) and connected at an inner distal end to a middle of the first brace (16). The second brace (18) comprises a second brace opening (18A) there through. A motor (22) is connected to the plate wheel (14D) enabling rotation thereof.

The pizza screen manufacturing apparatus (10) may optionally further comprise a wheel (20) connected to the motor (22) and the plate wheel (14D).

Figure 2:
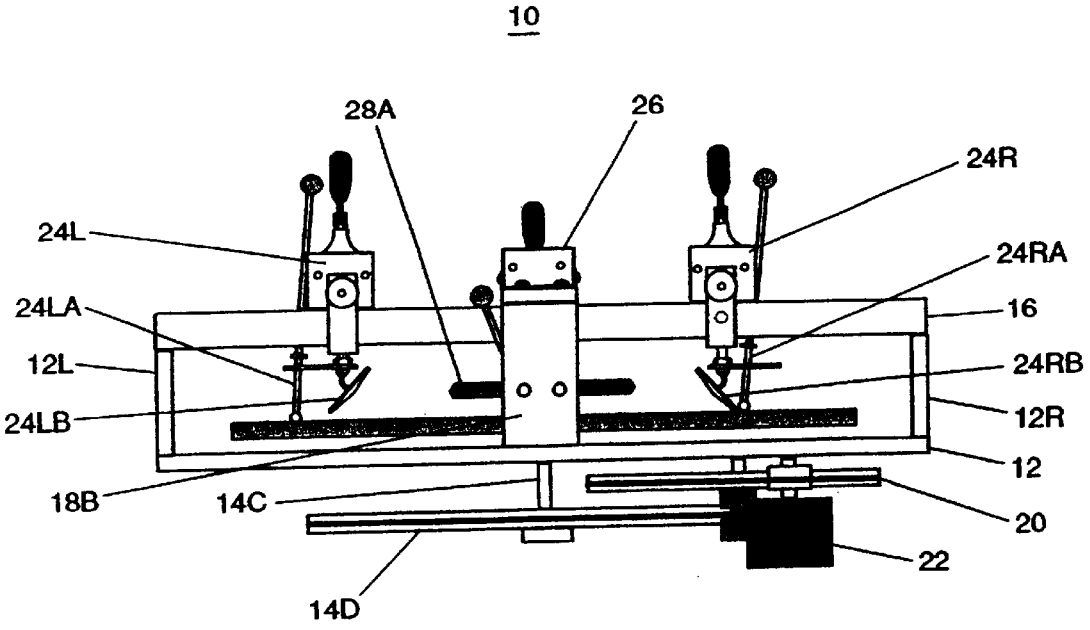
FIG. 2 is a front view of a pizza screen manufacturing apparatus (10).
Figure 5:
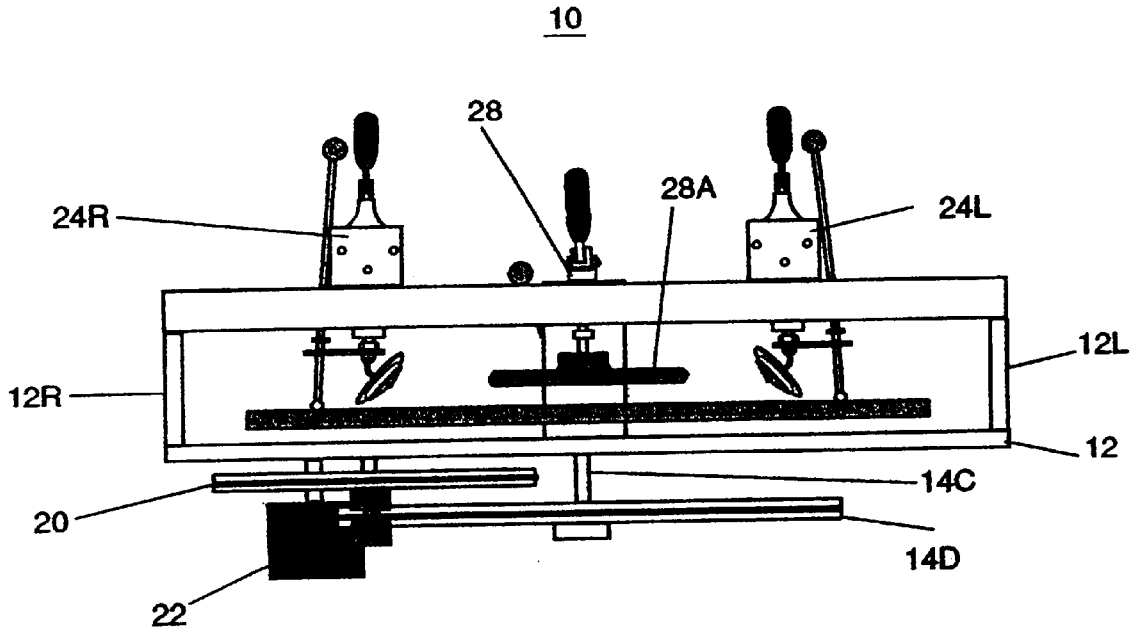
FIG. 5 is a rear view of a pizza screen manufacturing apparatus (10).

Now referring to FIG. 2 and FIG. 5 which are front and rear views of a pizza screen manufacturing apparatus (10) which comprises a folder (24L) is movably positioned within the first brace left opening (16L). The folder (24L) comprises a folder stylus (24LA) and a folder disc (24LB). The folder stylus (24LA) functions to crease the screen by applying pressure against the plate groove (14A). The folder disc (24LB) bends over the screen edge and thereafter flattens it.

A crimper (24R) is movably positioned within the first brace right opening (16R). The crimper (24R) comprises a crimper stylus (24RA) and a crimper disc (24RB). The crimper stylus (24RA) functions to crease the screen by applying pressure against the plate groove (14A). The crimper disc (24RB) bends over the screen edge and thereafter flattens it.

Figure 3:
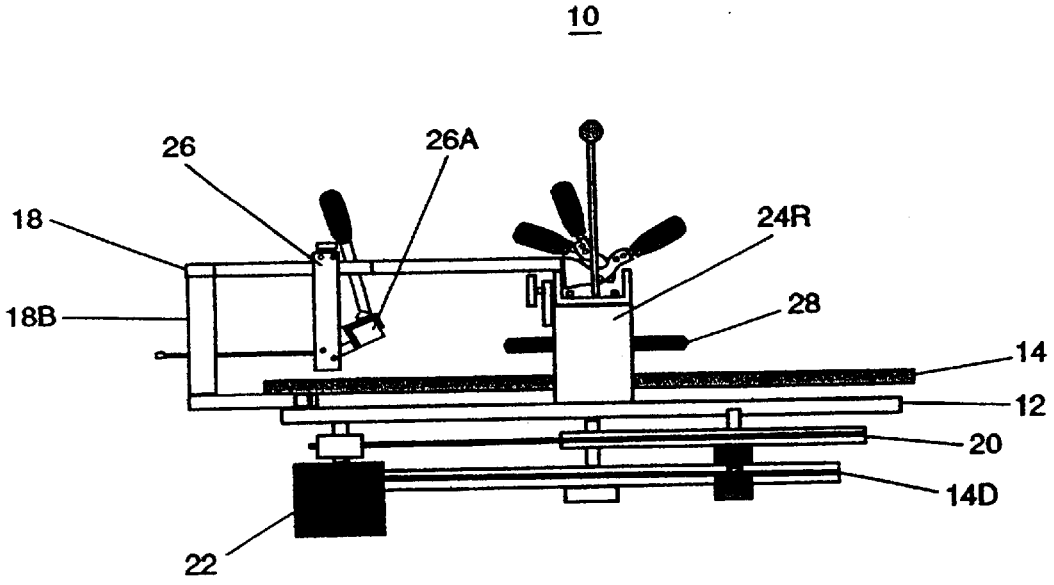
FIG. 3 is a right view of a pizza screen manufacturing apparatus (10).
Figure 4:
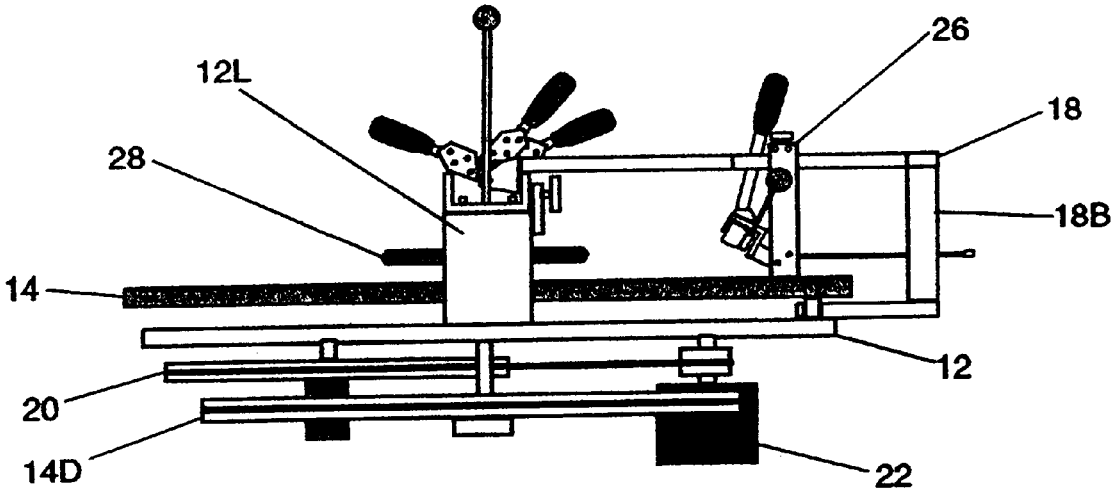
FIG. 4 is a left view of a pizza screen manufacturing apparatus (10).

Lastly, referring to FIG. 3 and FIG. 4 which are right and left views of a pizza screen manufacturing apparatus (10). A flattener (26) is movably positioned within the second brace opening (18A). The flattener (26) comprises a flattener roller (26A) extending therefrom. A press (28) is centrally mounted on the first brace (16). The press (28) further comprises a press plate (28A) extending downwardly therefrom.

It will be understood that each of the elements described above, or two or more together, may also find a useful application in other types of constructions differing from the type described above.

While the invention has been illustrated and described as embodied in a pizza screen manufacturing apparatus, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Ltters Patent is set forth in the appended claims.

What is claimed is:

1. A pizza screen manufacturing apparatus (10) comprising:

A) a base (12) having a right base stanchion (12R) and left base stanchion (12L);

B) a plate (14) rotatably mounted on the base (12), the plate (14) comprises a plurality of circular plate grooves (14A) and a flat plate center (14B), a plate shaft (14C) is securely connected at a top distal end to a bottom center of the plate (14) extending downwardly therefrom and securely connected at a bottom distal end to a center of a plate wheel (14D);

C) a first brace (16) securely connected to the base (12) on a left side by the left base stanchion (12L) and securely connected on a right side by the right base stanchion (12R), the first brace (16) comprises a first brace left opening (16L) and a first brace right opening (16R);

D) a second brace (18) connected at an outer distal end to the base (12) by a second brace sanction (18B) and connected at an inner distal end to a middle of the first brace (16), the second brace (18) comprises a second brace opening (18A) therethrough;

E) a motor (22) is connected to the plate wheel (14D) enabling rotation thereof;

F) a folder (24L) is movably positioned within the first brace left opening (16L), the folder (24L) comprises a folder stylus (24LA) and a folder disc (24LB);

G) a crimper (24R) is movably positioned within the first brace right opening (16R), the crimper (24R) comprises a crimper stylus (24RA) and a crimper disc (24RB);

H) a flattener (26) is movably positioned within the second brace opening (18A), the flattener (26) comprises a flattener roller (26A) extending therefrom; and I) a press (28) is centrally mounted on the first brace (16), the press (28) further comprises a press plate (28A) extending downwardly therefrom.

2. The pizza screen manufacturing apparatus (10) as described in claim 1, further comprises a wheel (20) connected to the motor (22) and the plate wheel (14D).

* * * * *